United States Patent [19]

Raudsepp et al.

[11] Patent Number: 4,878,945

[45] Date of Patent: Nov. 7, 1989

[54] HYDROMETALLURGICAL PROCESS FOR TREATING REFRACTORY ORES CONTAINING PRECIOUS METALS

[76] Inventors: Rein Raudsepp, 4539 Quebec St.; Morris J. Beattie, 2955 W. 38th Ave., both of Vancouver, B. C., Canada

[21] Appl. No.: 98,517

[22] Filed: Sep. 18, 1987

Related U.S. Application Data

[63] Continuation-in-part of Ser. No. 868,029, May 29, 1986, abandoned.

[51] Int. Cl.[4] ..... C22B 11/04

[52] U.S. Cl. ..... 75/118 R; 75/2; 75/97 A; 75/101 R; 75/103; 75/108; 75/109; 423/27; 423/34; 423/42; 423/87; 423/140; 423/143; 423/150; 423/594; 423/602; 204/109

[58] Field of Search ..... 75/2, 97 A, 101 R, 103, 75/108, 109, 118 R; 423/27, 34, 42, 87, 140, 143, 150, 594, 602; 204/109

[56] References Cited

U.S. PATENT DOCUMENTS

| | | | |
|---|---|---|---|
| 2,477,469 | 6/1946 | Thompson | 75/118 R |
| 2,805,936 | 9/1957 | Schaufelberger | 423/41 |
| 2,835,569 | 5/1958 | Reynaud et al. | 423/87 |
| 2,959,467 | 11/1960 | Mehmed Yusef | 423/144 |
| 3,793,429 | 2/1974 | Queneau | 75/118 R |
| 3,888,748 | 6/1975 | Brennecke | 423/145 |
| 3,965,239 | 6/1976 | Posel | 423/41 |
| 4,331,469 | 5/1982 | Kunda | 75/118 R |
| 4,647,307 | 3/1987 | Raudsepp et al. | 75/118 R |

OTHER PUBLICATIONS

Bailor, J. C. Jr. et al. *Comprehensive Inorganic Chemistry*; vol. 3, 1970, pp. 16–97.

Peters "Direct Leaching of Sulphides: Chemistry and Applications" The 1976 Extractive Metallurgy Lecture, The Metallurgical Society of AIME, Reprinted from Metallurgical Transactions vol. 7B #4, Process Metallurgy Dec. 1976.

*Primary Examiner*—Robert L. Stoll

[57] ABSTRACT

This invention is directed to an improved process for leach treating gold and silver bearing pyritic and arsenopyritic concentrates and ores. More particularly, the improved process avoids the necessity of adding recycled neutralized solution to the leach solution, thereby alleviating difficulties in maintaining acid levels in the leach solution, and provides for bleeding solutions containing dissolved arsenic, iron and sulphate from the process without the loss oxidized nitrogen species. The process can be carried out in one or more tubular reactors. The process for recovering valuable metals from pyritic and arsenopyritic concentrates and ores involves decomposing the arsenopyrite or pyrite concentrates and ores in acidic solution in a common volume space which contains a gas phase and a liquid slurry (which comprises a liquid phase and a solid phase) through the action of higher valence oxidized nitrogen species in which the nitrogen has a valence of at least plus 3. The active oxidized nitrogen species are regenerated in the same common volume space by an oxygen containing gas. The concentrate or ore is introduced into a denitrating step along with a solution from the leach solution. Essentially all of the oxidized nitrogen species in the leach solution is reacted with concentrate or ore to produce in the denitrating step nitric oxide which is released into an oxygen free gas phase and is transported to the gas phase of the common volume species. The liquid and solid products of the denitrating step are subjected to a solid-liquid separation, after which the solids from the separation step are transported to a leaching vessel where the solids are treated with oxygen and nitric oxide replaced from the denitrating step.

18 Claims, 2 Drawing Sheets

HYDROMETALLURGICAL PROCESS FOR TREATING REFRACTORY ORES CONTAINING PRECIOUS METALS

FIELD OF THE INVENTION

This application is a continuation-in-part of application Serial No. 868,029, filed May 29, 1986, now abandoned.

This invention is directed to an improved process for leach treating gold and silver bearing pyritic and arsenopyritic concentrates and ores. More particularly, the improved process avoids the necessity of adding recycled neutralized solution to the leach solution, thereby alleviating difficulties in maintaining acid levels in the leach solution and provides for bleeding solutions containing dissolved arsenic, iron and sulphate from the process without the loss of oxidized nitrogen species.

BACKGROUND OF THE INVENTION

In U.S. Pat. No. 4,647,307, granted Mar. 3, 1987, we disclose a hydrometallurgical process for the recovery of precious metal from a concentrate or ore containing at least some arsenopyrite or pyrite wherein at least some of the precious metal is occluded in the arsenopyrite or pyrite. The hydrometallurgical process involves forming in a common volume space a gas phase and a liquid slurry which comprises the ore or concentrate as the solid phase and acid and water as the liquid phase of the slurry. An oxidation-reduction reaction having a standard potential between about 0.90 and about 1.20 volts on the hydrogen scale is effected in the slurry between the arsenopyrite or pyrite and an oxidized nitrogen species in which the nitrogen has a valence of at least plus 3. This solubilizes in the liquid phase the arsenic, iron and sulphur in the arsenopyrite, or the iron and sulphur in the pyrite, all as the oxidation products, and produces in the liquid phase nitric oxide in which the nitrogen has a valence of plus 2, as the reduction product. At least part of the nitric oxide from the liquid phase is released into the gas phase. The nitric oxide in the gas phase, in which a significant oxygen partial pressure is maintained by continuous addition of an oxygen containing gas, is oxidized to form an oxidized nitrogen species in which the nitrogen has a valence of at least plus 3. The total amount of oxygen that is added is at least in an amount stoichiometrically required for solubilization in the liquid phase of the arsenic, iron and sulphur in the arsenopyrite, or the iron and sulphur in the pyrite. The oxidized nitrogen species is absorbed into the slurry wherein the oxidized nitrogen species become available for the oxidation-reduction reaction as described. In this way, the nitrogen, in its oxide forms, functions as a catalyst for the transport of oxygen from the gas phase to the oxidation-reduction reactions in the slurry. This permits the total of the oxidized nitrogen species and nitric oxide in the system to be substantially less than a stoichiometric balance that would be required for the oxidation of the arsenic, iron and sulphur. The slurry is then subjected to a solid-liquid separation to produce a solid residue and a liquid fraction. Precious metal is recovered from the solid residue.

While the process described has a number of unique features and important advantages, which are fully discussed in U.S. Pat. No. 4,647,307, the process has four minor shortcomings which were not apparent when the process was invented and which are briefly described below:

1. A bleed solution must be utilized in order to remove impurities which build up in the solution. Unfortunately, this bleed solution removes not only impurities but also valuable catalyst from the process. This causes higher operating costs for the process.

2. The recycle solution in the process is saturated in dissolved calcium (calcium nitrate). When this solution is recycled to the common volume space, and leaching proceeds, the sulphate which is formed in solution tends to combine with the calcium from the recycled solution to form calcium sulphate. Such calcium sulphate increases the weight of solids leaving the reaction autoclave and thereby increases the burden on the downstream cyanide circuit. The tendency to form calcium sulphate in solution causes the build-up of this material on heat exchanger surfaces, which reduces process efficiency over time.

3. Since the recycle solution is neutral (with regard to pH) the introduction of this recycle stream into the common volume space can cause difficulties in maintaining the leach solution at a sufficient acid concentration.

4. It was extremely difficult when the process was conducted in an autoclave to remove heat from the reaction at a sufficient rate to hold down temperatures in the autoclave to preferred operating temperatures. This shortcoming would cause considerable engineering problems in designing a production size processing facility.

SUMMARY OF THE INVENTION

The invention is directed to an improved hydrometallurgical process for recovering precious metals from pyritic and arsenopyritic concentrates and ores involving decomposing the arsenopyrite or pyrite concentrates and ores in acidic solution in a common volume space which contains a gas phase and a liquid slurry (which comprises a liquid phase and a solid phase) through the action of higher valence oxidized nitrogen species in which the nitrogen has a valence of at least plus 3. The active oxidized nitrogen species is regenerated in the same common volume space by an oxygen containing gas. The improvement comprises introducing the concentrate or ore into a denitrating step, along with the solution from the leach. Essentially all of the oxidized nitrogen species present in the leach solution react with the concentrate or ore to produce in the denitrating step nitric oxide which is released into an oxygen free gas phase. The oxygen free nitric oxide gas phase is transported to the gas phase of the common volume space. The liquid and solid products of the denitrating step are then subjected to a solid liquid separation. The solids from the separation are transported to the solid phase of the common volume space where the solids are treated with oxygen and nitric oxide taken from the denitrating step. The remaining liquid is free of oxidized nitrogen species and is bled from the process. Some of the remaining liquid is recycled to the denitrating step to maintain material balance in the process. Acid in the recycled liquid reacts with any carbonates in the concentrate or ore to release carbon dioxide gas at an early stage thereby preventing carbon dioxide gas from being released in the common volume space.

Specifically, the process which is intended for the recovery of precious metal from an ore or concentrate containing at least some arsenopyrite or pyrite wherein at least some of the precious metal is occluded in arsenopyrite or pyrite, comprises: (a) introducing pyrite or arsenopyrite concentrate or ore into a denitrating vessel where the concentrate or ore is subjected to an oxidation-reduction reaction with a recycled solution which is derived from the process after precious metal has been precipitated; (b) continuously removing nitric oxide gas which is generated in an oxygen free gas phase; (c) continuously withdrawing the treated concentrate or ore from the denitrating vessel and subjecting it to a solid-liquid separation; (d) partially recycling the liquid which is free of oxidized nitrogen species from the solid-liquid separation to the pyrite or arsenopyrite ore of step (a) and discarding the remaining liquid from the process; (e) transporting the solids from the solid-liquid separation to a common volume space; (f) forming in the common volume space a gas phase and a liquid slurry comprising the solids from step (d) as the solid phase, acid and water as the liquid phase of the slurry, and nitric oxide gas from step (b) above and oxygen as the gas phase; (g) effecting in the liquid slurry between the arsenopyrite or pyrite and an oxidized nitrogen species in which the nitrogen has a valence of at least plus 3 an oxidation-reduction reaction having a standard potential between about 0.90 and about 1.20 volts on the hydrogen scale, thereby solubilizing in the liquid phase the arsenic, iron and sulphur in the arsenopyrite, or the iron and sulphur in the pyrite, all as the oxidation products, and producing in the liquid phase nitric oxide in which the nitrogen has a valence of plus 2, as the reduction product; (h) releasing at least part of the nitric oxide generated in the liquid phase into the gas phase; (i) oxidizing the nitric oxide in the gas phase, in which a significant oxygen partial pressure is maintained by continuous addition of an oxygen containing gas, to form an oxidized nitrogen species in which the nitrogen has a valence of at least plus 3, the total amount of oxygen added being at least in an amount stoichiometrically required for solubilization in the liquid phase of the arsenic, iron and sulphur in the arsenopyrite or the iron and sulphur in the pyrite; (j) absorbing the oxidized nitrogen species into the liquid slurry wherein the oxidized nitrogen species become available for the oxidation-reduction reaction of step (g) whereby the nitrogen, in its oxide forms, functions as a catalyst for the transport of oxygen from the gas phase to the oxidation-reduction reactions in the liquid slurry, thereby permitting the total of the oxidized nitrogen species and nitric oxide in the system to be substantially less than a stoichiometric balance required for the oxidation of the arsenic, iron and sulphur; (k) subjecting the liquid slurry to a solid liquid separation to produce a solid residue and a liquid fraction; (l) recovering precious metal from the solid residue; and (m) recycling the liquid fraction to step (a) of the process.

This improved process has a number of important advantages compared to existing processes.

1. The denitrating step produces a bleed solution for impurity removal which is (essentially) free of catalyst.

2. The denitrating step generates important nitric oxide gas for the leach process. Instead of being obliged to recycle nitrate containing solutions, the nitric oxide gas represents a pure reactant which can be added directly to the gas phase of the common volume space.

3. The denitrating step avoids having to recycle in the process solution which contains deleterious dissolved calcium.

4. The denitrating step avoids having to recycle in the process neutralized solutions which lower the said concentration in solution to below desired level.

5. The denitrating step lends itself to the use of a tubular reactor which enables process parameters to be controlled more closely than is possible with autoclaves.

6. The common volume space can be a tube which permits close control within desired limits of the process reactions such as temperature and pressures.

7. The use of tubular reactors for the denitrating step and the leach process in the common volume space enable reaction to proceed in advantageous "plug flow" manner thereby preventing well known "backmixing" of liquid and gas phases which occur in continuous autoclave processes.

8. The use of tubular reactors with plug flow characteristics enables less expensive gases with lower oxygen concentrations, including air, to be used in the process.

DRAWINGS

In the drawing which discloses a specific embodiment of the improved process:

FIG. 1 illustrates a graphic flowsheet of the improved process of the invention; and FIG. 2 illustrates a graphic flowsheet of the improved process utilizing tubular reactors.

DETAILED DESCRIPTION OF A SPECIFIC EMBODIMENT OF THE INVENTION

Figure 1:
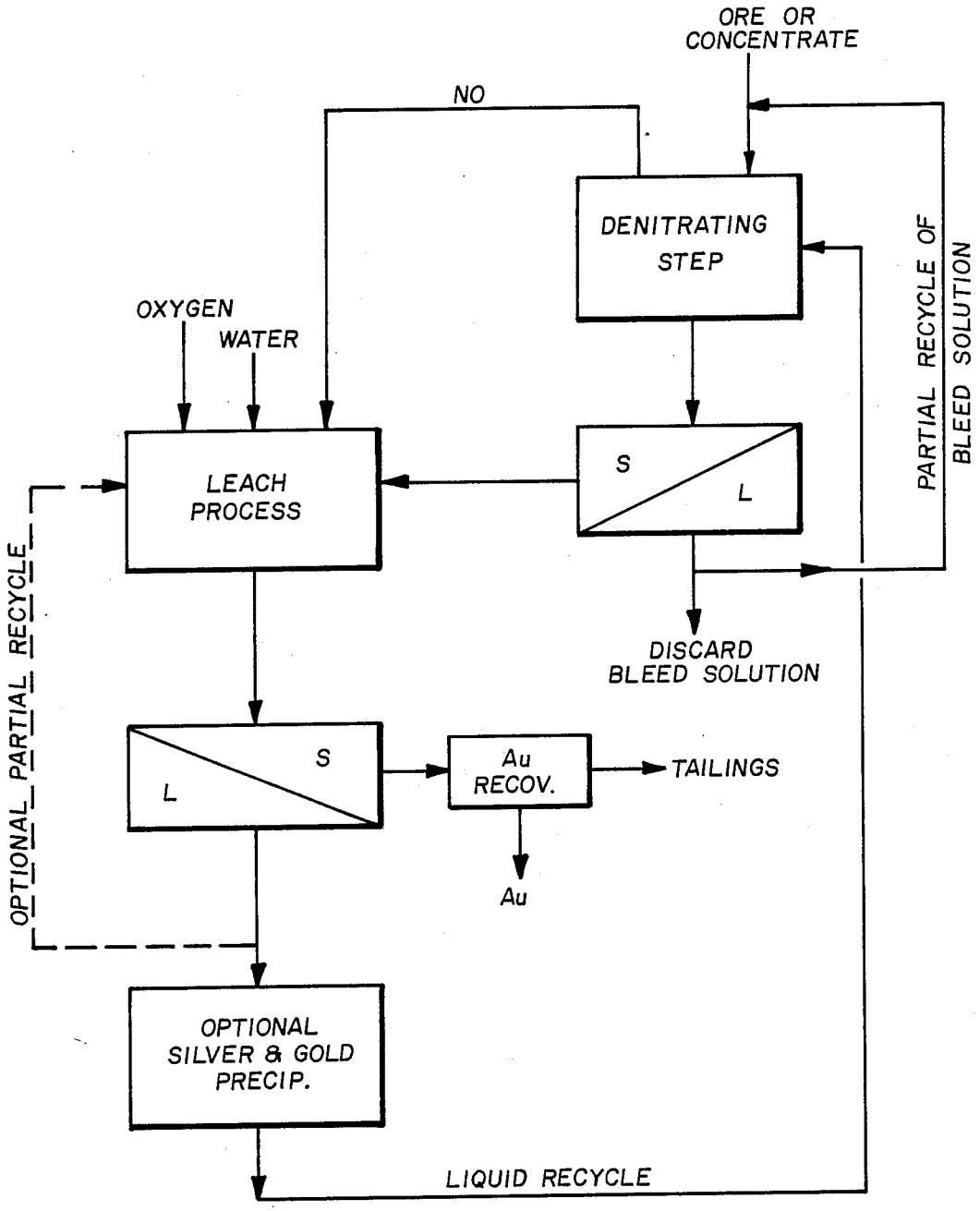

The improved hydrometallurgical process is basically intended for the recovery of precious metal from an ore or concentrate containing arsenopyrite or pyrite wherein at least some of the precious metal is occluded in the arsenopyrite or pyrite. In this specification and the following claims, "pyrite" refers to and includes marcasite which has the same composition as pyrite (understood in the conventional sense) but a different crystal structure. The improvement comprises first introducing the concentrate or ore into a denitrating step, along with the solution from the leach. The oxidized nitrogen species present in the leach solution react with the concentrate or ore to produce nitric oxide which is released into the oxygen free gas phase. The liquid and solid products of the denitrating step are subjected to a liquid-solid separation. The resultant solids from the separation are introduced into the leaching vessel where the solids are treated with oxygen and nitric oxide from the denitrating step.

A gas phase and a liquid slurry are formed in the leaching vessel. The liquid from the denitrating step is a bleed to the process. The slurry is comprised of the ore or concentrate as a solid phase and acid and water as a liquid phase. An oxidation-reduction reaction having a standard potential between about 0.90 and about 1.20 volts on the hydrogen scale is effected in the slurry between the arsenopyrite or pyrite and an oxidized nitrogen species in which the nitrogen has a valence of at least plus 3. Arsenic, iron and sulphur in the arsenopyrite, or iron and sulphur in the pyrite, are solubilized in the liquid phase as oxidation products. Nitric oxide in which the nitrogen has a valence of plus 2 is produced as a reduction product in the liquid phase. At least part of the nitric oxide is released from the liquid phase into the gas phase. The nitric oxide in the gas phase, in which a significant oxygen partial pressure is maintained by the continuous addition of an oxygen containing gas, is oxidized to form an oxidized nitrogen species in which the nitrogen has a valence of at least plus 3. The total amount of oxygen added is at least in an amount that is stoichiometrically required for solubilization in the liquid phase of the arsenic, iron and sulphur in the arsenopyrite, or the iron and sulphur in the pyrite. The oxidized nitrogen species are absorbed into the slurry wherein the oxidized nitrogen species become available for the oxidation-reduction reaction. The nitrogen, in its oxide forms, functions as a catalyst for the transport of oxygen from the gas phase to the oxidationreduction reactions in the slurry. This permits the total of the oxidized nitrogen species and nitric oxide in the system to be substantially less than a stoichiometric balance required for the oxidation of the arsenic, iron and sulphur. The slurry is removed from the common volume space and is subjected to a solid liquid separation to produce a solid residue and a liquid fraction. Precious metal is recovered from the solid residue.

The arsenopyrite and pyrite are decomposed by the oxidation-reduction reaction in acid solutions in the slurry where the pH is less than about 1.0 to about 3 by the action of oxidized nitrogen species where the nitrogen has a valence of plus 3 or greater. These oxidized nitrogen species include nitrous acid and nitrogen dioxide. The oxidized nitrogen species are present in sufficient concentration in the liquid fraction (typically about 0.25 Molar (M) to about 4.0 Molar (M), calculated on a nitric acid basis) to provide an adequate rate of dissolution (typically within a residence time of about 2 minutes to about 60 minutes) at the reaction temperature used (typically about 60° C. to about 119° C. for arsenopyrite concentrate and about 60° C. to about 180° C. for pyrite concentrate or ore). Normally, the lower oxidized nitrogen species concentrations and longer residence times are used when treating ore while the higher oxidized nitrogen species concentrations and shorter residence times are used when treating concentrates.

The main products from, the oxidation-reduction reaction are soluble ferric iron species, soluble arsenate species, soluble sulphate species, minor amounts of elemental sulphur and nitric oxide.

Insoluble gangue minerals and elemental sulfur remain as solids in the slurry. The slurry is subjected to a solid-liquid separation to yield a solid residue and a liquid fraction. A major portion of the gold or other precious metal contained in the concentrate or ore remains in the solid residue. Some of the gold or other precious metal appears in the leach solution, and can be recovered with activated carbon.

Almost all of the silver present in the concentrate will usually remain in the liquid fraction. The silver can be recovered from the liquid fraction by using a thiocyanate compound such as sodium thiocyanate, potassium thiocyanate, or ammonium thiocyanate. Arsenic and iron can be optionally removed from the silver- free separated liquid fraction by elevating the temperature to precipitate ferric arsenate. In the case of pyrite, iron can be removed from the liquid fraction.

In general terms, the process of the invention can be operated at a standard potential between the arsenopyrite or pyrite and the oxidized nitrogen species of about 0.90 volts and about 1.20 volts on the hydrogen scale. At potentials below about 0.9 volts, arsenopyrite or pyrite will not decompose efficiently. At potentials above about 1.2 volts, no significant oxidation of the nitrogen species will take place because oxygen per se has a potential of about 1.23 volts on the hydrogen scale.

On the standard oxidation-reduction potential scale, the reduction of nitrous acid to nitric oxide has a standard potential of about 0.996 volts. The reduction of nitrate to nitrous acid has a standard potential of about 0.94 volts. Thus the former couple has a higher driving force than the latter in decomposing sulphide minerals such as arsenopyrite and pyrite.

Preferably, the process of the invention is operated at a potential greater than about 0.94 volts up to about 1.0 volts on the hydrogen scale.

The process can typically be conducted within a residence time range of about 2 minutes to about 60 minutes calculated on a plug flow basis. A process which is completed in a time less than about 2 minutes is difficult to control and basically impractical. On the other hand, a process which takes more than about 60 minutes to complete is too slow and thus uneconomical.

The process has been conducted experimentally at initial temperatures from above the freezing point of the slurry to temperatures of several hundred degrees Celsius. However, temperatures falling in the range of about 60° C. to about 180° C. are preferred for economical reasons. Similarly, the process has been conducted at pH ranges of less than about 1.0 to as high as about 3.0. In situations where silver is not present, and the formation of basic iron sulphate or jarosite can be tolerated in the process, the process can be conducted at a pH of about 3.0. However, silver is usually present and therefore it is preferable to operate the process at lower pH ranges. Typically, a pH of about 1.0 or below is preferred because it is desirable to keep the iron and arsenic in solution. Also, the process is more rapid and economical at a pH range of less than about 1.0.

In the process, the oxidized nitrogen species in a sense act as a transporter of oxygen. The basic process may be regarded as an oxygen leach rather than an oxidized nitrogen species or nitric acid leach. The oxidized nitrogen species serves as a carrier for the oxygen as the oxidized nitrogen species is cycled between the gas phase and the liquid phase of the slurry of the common volume space. It follows that the rate at which the reaction proceeds is proportional to the number of oxidized nitrogen species carriers that are in the process.

Sufficient oxygen must be supplied to the leaching vessel in order to completely decompose the arsenopyrite and pyrite in the slurry. Nitric oxide derived from the denitrating step is also introduced into the leach vessel. If insufficient oxygen is supplied, then the pressure of the nitric oxide generated increases and ultimately the reaction stops because there are no oxidized nitrogen species left in the liquid phase of the slurry.

In order to overcome the limitations of utilizing a bleed which removes valuable catalyst from the process, and introducing into the leach vessel a neutral recycled solution which promotes calcium sulphate formation and causes difficulties in maintaining the leach solution at appropriate acid levels, while at the same time retaining and utilizing all of the unique and advantageous features of our basic arsenopyrite and pyrite treating process, we have developed a variation of the basic process which does not introduce the concentrate in the leach. The improved process is described in association with the flow sheets which are illustrated in FIGS. 1 and 2.

Figure 2:
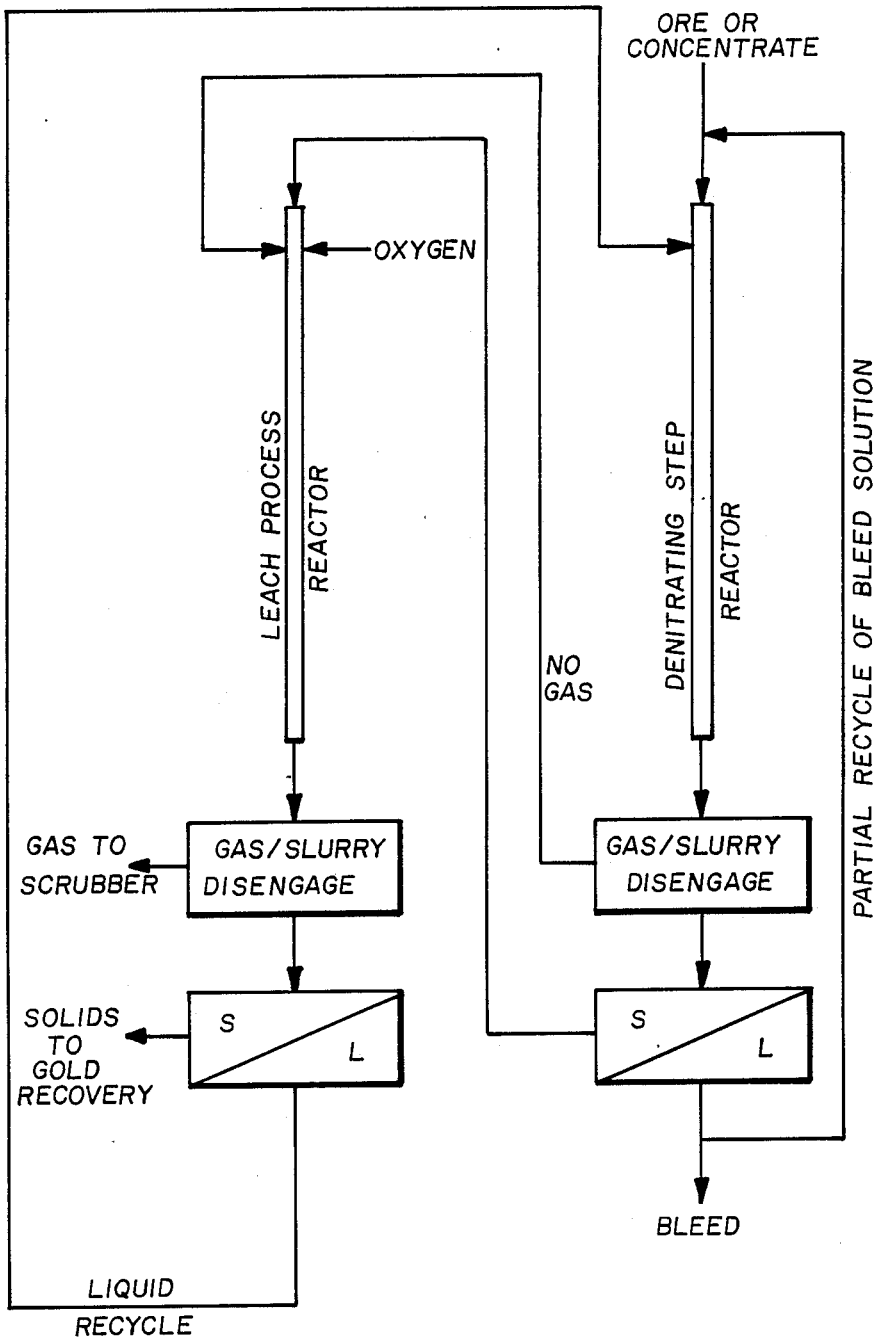

In the process as illustrated in the flowsheets of FIG. 1 and FIG. 2, the concentrate is introduced into a preliminary denitrating stage along with a recycled solution which is derived from the leach after gold and silver precipitation. The liquid and solids of the denitrating stage are subjected to a solid-liquid separation. The solids are transported to the leach vessel. Nitric oxide from the denitrating stage is also introduced into the leach vessel. The nitrate in the leach solution reacts with the arsenopyrite and pyrite concentrate according to the following general process criteria and leaching reactions:

A. Mineral Oxidations $$\text{Fe AsS} \rightarrow Fe^{+3}(aq) + \tfrac{1}{2}As_2S_2 + 3e \quad (1)$$

$$FeAsS + 3H_2O \rightarrow Fe^{+3} + H_3AsO_3 + S^0 3H^+ + 6e \quad (2)$$

$$FeAsS + 4H_2O \rightarrow Fe^{+3} + H_3AsO_4 + S^0 + 5H^{++} 8e \quad (3)$$

$$FeAsS + 8H_2O \rightarrow Fe^{+3} + H_3AsO_4 + SO_4 = + 13H^{++} 14e \quad (4)$$

$$FeS_2 \rightarrow Fe^{+3}(aq) + 2S^0 + 3e \quad (5)$$

$$FeS_2 + 8H_2O \rightarrow Fe^{+3} + 2SO_4 = + 16H^{++} 15e \quad (6)$$

B. Oxidized Nitrogen Species Reduction $$HNO_3 + 3H^{++} 3e \rightarrow NO(g) + 2H_2O \quad (7)$$

$$HNO_2 + H^{++} e \rightarrow NO(g) + H_2O \quad (8)$$

In the oxidation of arsenopyrite, it has been found that 60–90% of the mineral's sulphur is converted to soluble sulphate species. In the oxidation of pyrite, the degree of conversion is 80–100%.

Equations A(1) and A(5) will, in principle, take place at potentials above about 0.6 volts on the hydrogen scale; however, since $\frac{1}{2}$ ($As_2S_2$) on arsenopyrite and $2S^0$ on pyrite have molar volumes larger than FeAsS and $FeS_2$ respectively, the first submicroscopic layers of these leach products protect the mineral from further oxidation, and no substantial reaction is observed. At potentials above about 0.94 volts on the hydrogen scale, reactions A(4) and A(6) take place, and the protective layers of $As2S_2$ and $S^0$ are eliminated by oxidation.

In the denitrating step, reaction B(7) absorbs electrons at a standard potential of 0.94 volts on the hydrogen scale, just barely adequate to remove electrons from arsenopyrite and pyrite to drive reactions A(4) and A(6) at a feasible rate (as in Queneau). Reaction B(8), which takes place in the leach process, absorbs electrons at a standard potential of 0.996 volts on the hydrogen scale, which is high enough to drive reactions A(4) and A(6) rapidly at temperatures as low as 60° C.

The active nitrogen oxides are required only to act as a sink for electrons which are released by decomposition of the minerals in the concentrate or ore. The oxidized nitrogen species should be present in sufficient concentration in the solution (typically about 0.25 M to about 3.0 M or 4.0 M) to provide an adequate rate of dissolution (typically within a residence time of about 2 minutes to about 60 minutes) at the reaction temperature used (typically about 60° C. to about 119° C. for arsenopyrite concentrate, and about 60° C. to about 180° C. for pyrite concentrate or ore). Sulphuric acid may be used to form the soluble ferric iron species and under certain circumstances is produced in situ.

In the following reaction, nitrous acid is the decomposition agent for arsenopyrite with sulphuric acid present.

$$FeAsS + \tfrac{1}{2}H_2SO_4 + 14HNO_2 \rightarrow \tfrac{1}{2}Fe_2(SO_4)_3 + H_3AsO_4 + 14NO(g) + 6H_2O \quad (9$$

Sufficient sulphuric acid was supplied with arsenopyrite and was consumed to form soluble ferric iron species. Without such acid, compounds will precipitate from solution.

In the reaction detailed below, the sulphuric acid is generated from the decomposition of pyrite.

$$FeS_2 + 15HNO_2 \rightarrow \tfrac{1}{2}Fe_2(SO_4)_3 + \tfrac{1}{2}H_2SO_4 + 15NO(g) + 7H_2O \quad (10)$$

In the preceding reactions, the active nitrogen oxides are reduced to nitric oxide which may then be regenerated by an oxidant. A useful oxidant is oxygen which reacts with nitric oxide in the presence of water to form nitrogen dioxide, nitrous acid and nitric acid as shown in the reactions set forth below.

$$NO + \tfrac{1}{2}O_2 \rightleftharpoons NO_2 \quad (11)$$

$$NO + NO_2 + H_2 \rightleftharpoons 2HNO_2 \quad (12)$$

$$3HNO_2 \rightleftharpoons HNO_3 + H_2O + 2NO \quad (13)$$

While the leach process is in continuous operation, the generation of nitric acid (reaction (13)) is not desirable and is to be avoided. This is accomplished by conducting reactions A(4) and A(6), B(8) and reactions (11) and (12) in a common volume space where the nitrous acid can be readily consumed by reactions (9) and (10) so as not to form nitric acid according to reaction (13). The regeneration of nitric oxide to the higher valence states is done concurrently with the decomposition of pyrite in the common volume space.

It is clear from equations (11) to (13) that $HNO_2$ is the principal dissolved oxidized nitrogen species arising from the gas phase oxidation of NO and dissolution of the resulting $NO_2$. Reaction (13) is rather slow, and $HNO_2$ is therefore the principal dissolved oxidized nitrogen species that is able to react with the oxidizable minerals (reactions (9) and (10)). Oxygen is used for nitrogen oxide regeneration. The rate of regeneration varies directly with oxygen partial pressure. Any oxygen partial pressure above ambient is adequate, but oxygen partial pressures of about 50 psig to about 100 psig are preferred. The regeneration step is carried out with an oxygen containing gas concurrently with the decomposition reaction(s) (reactions A(4) and A(6)). The overall stoichiometry of arsenopyrite reacting with sulphuric acid and oxygen utilizing the oxidized nitrogen species as a catalyst (transporter) is illustrated by the reaction below.

$$\begin{array}{l} FeAsS + \tfrac{1}{2}H_2SO_4 \\ + 7/2\,O_2 + H_2O \\ + 14\,HNO_2 \end{array} \rightleftharpoons \begin{array}{l} \tfrac{1}{2}Fe_2(SO_4)_3 + \\ H_3AsO_4 + 14\,HNO_2 \end{array} \quad (14)$$

Since the active oxidized nitrogen species are regenerated during the decomposition step in the common volume space, the quantity of these species present at any time may be quite small.

It is apparent from equation calculations that the $HNO_3$ concentrations initially added are far too low to completely decompose so much arsenopyrite. If the initially present $HNO_3$ were the only oxidant, and remained the only oxidant, stoichiometric calculations would show that almost 5 moles of $HNO_3$ would have been required to completely decompose the 1 mole of arsenopyrite. This is evidenced by the following equation:

$$FeAsS + 14/3HNO_3 + H^+ \rightarrow Fe^{3+} + SO_4 = + \cdot H_3AsO_4 + 14/3\ NO(g) + 4/3H_2O \quad (15)$$

Yet, the mineral has been found to be completely decomposed by as little as 0.5 M $HNO_3$, or about 1/10 of the stoichiometric requirement, for example, oxidized nitrogen species cycled ten times. This illustrates the highly catalytic property of the oxidized nitrogen species.

At oxidized nitrogen species concentrations of 0.25 M or less, the decomposition rate is too slow to be a practical consideration. At oxidized nitrogen species concentrations of about 3.0 M, the reaction rate is very rapid and hence sufficient for most purposes. Greater concentrations than about 3.0 M do not provide greatly improved reaction rates.

The mineral decomposition and oxidized nitrogen species regeneration steps are both exothermic. Thus, in conducting the reactions, the slurry in the common volume space and the denitrating step must be cooled in order to maintain a constant operating temperature.

The decomposition leach can be carried out over a wide range of solid-liquid ratios. The solid-liquid ratio in the denitrating step is dictated by the mass balance of the overall process.

In the denitrating step, the objective is to treat the liquid recycle from the silver precipitation with feed concentrate or ore, in the absence of oxygen, in order to produce a bleed solution free of oxidized nitrogen species. This is accomplished by some of the leaching reactions which have been discussed above. Temperatures and pressures are generally similar except that the pressure in the denitrating step should be slightly greater than in the leaching step, eg. 20 to 50 psig greater, in order to drive the generated nitric oxide over to the leaching process in the common volume space. The time duration of the denitrating step is similar to the leaching step.

Following the denitrating step, a solid-liquid separation is effected. The partially leached solids from this separation step are transported to the leach vessel in order to be reacted according to the reactions which are fundamental to our basic leach process as discussed above. A part of the nitrate-free solution forms the partial recycle of the bleed solution which is added to the concentrate or ore to form a slurry which is pumped into the denitrating step. The remainder of the nitrate-free solution forms the bleed solution of the process which can be discarded or treated. The nitrate-free solution is neutralized with limestone and/or lime in order to reject the waste materials according to the normal procedures of our basic process.

Our improved process, among other things, has the advantage that any desired amount of solution can form a bleed to the process. The quantity of solution which is treated in the denitrating step relative to the amount of solution which is recycled directly to the leach as the optional recycle will depend on factors such as the iron and arsenic content of the concentrate. Another advantage of the preferred process, ie. no precipitation of iron, arsenic or sulphate from the liquid recycle, is that no neutralized solution is introduced into the leach.

The choice of oxidized nitrogen species concentration, decomposition temperature and time for leaching is governed by the nature of the material to be leached. Convenient initial sources of the oxidized nitrogen species are nitric oxide gas or nitric acid. The solids are decomposed in a single pass and no recycle of solids is required. When the decomposition reactions are complete, a solid-liquid separation is carried out to produce a solid residue containing the majority of the gold and a clarified liquid fraction which may contain some of the gold and silver.

The application of tubular reactors is another inventive aspect of the process. U.S. Pat. No. 4,472,359, Pietsch, Sept. 1984, discloses a process for leaching mineral material in an acid medium utilizing tubular reactors. In that process, acid was used to extract metal values from mineral material with an oxidizing agent being added when it was beneficial to do so. In the applicant's process, the unique features of tubular reactors were recognized as providing a novel solution to the problem of achieving a high degree of process control. In the leach process, nitric oxide gas, together with the ore or concentrate being treated and an oxygen containing gas, are introduced into a tubular reactor and reacted to complete oxidation. In the denitrating step, the ore or concentrate is introduced into the tubular reactor together with a liquid recycle from the process to produce nitric oxide gas, a partially leached solid fraction and a solution free of oxidized nitrogen species.

Since the leaching reactions are highly exothermic, in order to control the decomposition temperature within specified limits, it is desirable to use a reactor which has a high ratio of surface area for heat removal to contained volume. A tubular reactor provides such a high ratio. The tubular reactor has the added advantage that it is a plug-flow reactor into which the oxygen, water, nitric oxide gas and ore or concentrate can be fed at one end and completely reacted products removed from the other end. In this way, partially reacted solids or gaseous products are not removed with completely reacted products due to mixing within the reactor. When the pyrite or arsenopyrite is completely oxidized, the production of nitric oxide gas ceases and its concentration in the gas phase decreases. Since the oxidation of nitric oxide and the absorption of the resultant nitrogen dioxide are both rapid, by the time the slurry and residual gases leave the tubular reactor, the concentration of oxidized nitrogen species in the gas phase is low, ie. less than 2000 ppm $NO_x$, The remaining $NO_x$ are easily scrubbed from the exit gas with standard gas handling equipment. The losses of catalyst to the exit gas are very low, therefore, and the volume of gas which is allowed to exit the reactor along with the treated slurry does not have to be minimized. This permits the use of low purity oxygen or even air as the source of oxygen for the reactions in the leach process since the loss of catalyst to the inert gases which must be bled from the process is minimal.

The application of tubular reactors to the denitration step utilizes the feature of these reactors that when an ore or concentrate together with a solution containing oxidized nitrogen species is introduced into the reactor, the sulphides in the ore or concentrate will be oxidized to produce nitric oxide gas, partially reacted solids and a solution which is free of oxidized nitrogen species. This represents a unique application of tubular reactors to treating ores or concentrates in that a large volume of nitric oxide gas is produced in the process. The release of gas from the slurry/gas disengagement vessel following the tubular reactor is controlled to maintain a pressure in this system which is higher than that in the leach process. In this way, the difference in pressure between the two parts of the process can be used to feed the nitric oxide gas into the leach process.

A possible flowsheet utilizing tubular reactors to achieve the desired objectives is shown in FIG. 2.

Silver may be recovered from the liquid fraction as a thiocyanate compound. Alternatively, silver and gold may be recovered from the liquid fraction with active carbon.

Arsenic, iron and sulphur may be removed from solution according to known techniques and by following the teachings and procedures disclosed in U.S. Pat. No. 4,647,307, granted Mar. 3, 1987.

Various trace elements such as copper, magnesium, zinc, bismuth or tellurium may be present in the concentrate being treated. While some of these trace elements will report to the solid residue or waste precipitation residues, some may build up in the liquid phase or the liquid fraction and have to be bled-off. When trace elements are present in sufficient concentration, their recovery may be economically justified.

The process is effective in treating arsenopyritic and pyritic ores which contain carbonaceous material. Some of this carbonaceous material may be active and thus interfere with precious metal recovery. The process renders such carbonaceous material inactive so that the material does not interfere with subsequent gold recovery.

The practice of the invention is not limited to the treatment of gold and silver bearing pyritic and arsenopyritic concentrates and ores. Kunda (U.S. Pat. No. 4,331,469) discloses a process for the recovery of silver values from silver - containing material which also contains iron and arsenic. Kunda's process utilizes a nitric acid solution to leach the concentrate. His process suffers from the fact that the solutions can not be recycled and thus represents a loss of valuable reagent. The liquor leaving the process has a high content of ammonium nitrate and ammonium sulphate and therefore requires the plant to be associated with a fertilizer plant.

Utilizing our process, the nitric acid will react with the concentrate to form nitric oxide. In the oxidation leach this nitric oxide will be regenerated with oxygen to provide for complete oxidation of the sulphide and arsenide minerals. In the denitrating step the nitrates are recycled to the oxidation leach. A nitrate-free solution is produced for the recovery of dissolved metals and neutralization.

EXAMPLE 1

A batch test was done to demonstrate the use of the denitrating step for the removal of oxidized nitrogen species from the leach solution by contact with the feed concentrate.

A leach discharge solution was prepared by reacting a pyritic concentrate with a nitric acid solution in an autoclave. Oxygen was introduced into the autoclave as the leach proceeded in order to oxidize the nitric oxide so that the oxidized nitrogen species would be regenerated. After completion of the leaching the solution contained 12,000 mg per liter oxidized nitrogen species.

500 ml of this leach solution was placed in an autoclave with 100 g of the pyritic concentrate. The autoclave was sealed and then heated to 100° C. The denitrating leach was allowed to proceed until the pressure in the autoclave was at 170 psig due to nitric oxide production. At this point, the nitric oxide gas was vented from the autoclave to maintain an operating pressure of 160 psig The test was continued for 30 minutes during which time the pressure was decreased to 120 psig as the nitric oxide gas was vented.

Following this denitrating leach, the solution was analyzed and found to contain 94.6 mg per liter oxidized nitrogen species. This demonstrates 99.2% removal of nitrogen species from the leach solution.

This solution was further sparged with air to remove dissolved nitric oxide. After air sparging the solution contained 30 mq per liter oxidized nitrogen species indicating an overall removal of 99.7%.

EXAMPLE 2

A batch test was conducted to demonstrate the various steps in the process. The concentrate used for this sequence contained pyrite and arsenopyrite and had the following composition:

Fe=40.8%, As=11.1%, S=40.6%

3,300 q of this concentrate was leached in an autoclave according to the normal practice of our invention with 22 liters of solution containing 42,000 mg per liter of oxidized nitrogen species as nitric acid and sufficient oxygen to satisfy the requirements of the sulphide oxidation reactions. The solution from this leach had the following composition:

56.5 g/l Fe, 15.5 g/l As, 160 g/l $SO_4$ 6,900 g of this leach solution together with 1,050 g of water were combined with 1,050 g of fresh concentrate. A denitrating leach was done for 30 minutes at 100° C. with venting of the nitric oxide gas to maintain an operating pressure of 150 psig.

The discharge slurry from the denitrating leach was filtered to produce a partially leached residue and a solution. The solution had the following composition:

60.6 g/l Fe, 18.2 g/l As 163.5 g/l $SO_4$, 480 mg/l nitrates

Following purging with nitrogen for 5 minutes the nitrate content of the solution was reduced to 180 mg/l. This demonstrates 99.5% removal of oxidized nitrogen species in the denitrating leach.

The residue from this denitrating leach had the following composition:

Weight=823 g

F3=38.3%, As=8.6%, S - 43.9%

300 g of this residue was leached with 1,700 g of solution containing 3 m/l oxidized nitrogen species as nitric acid. Leaching was done in an autoclave under normal conditions for the process with oxygen being supplied to satisfy the oxidation requirements. The residue from this leach was analyzed as follows:

Weight=35.3 g

Fe=6.6%, As=9.8%

The overall iron extraction from the concentrate through the denitrating step plus oxidizing leach step was 98.5%. The arsenic extraction was 91.9%.

The above results demonstrate the sequence of steps in the process flowsheet. While the example utilized a nitric acid solution to leach the residue from the denitrating step, it has previously been demonstrated that under continuous or batch conditions, such leaching can be done utilizing the nitric oxide gas from the denitrating step together with oxygen.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. In a process for recovering precious metals from pyritic and arsenopyritic concentrates and ores involving decomposing the arsenopyrite or pyrite concentrates and ores in acidic leach solution in a common volume space which contains a gas phase and a liquid slurry which comprises a liquid phase and a solid phase through the action of higher valence oxidized nitrogen species in which the nitrogen has a valence of at least plus 3, the active oxidized nitrogen species being regenerated in the same common volume space by oxygen containing gas, the improvement which comprises, prior to decomposing said concentrate or ore in said common volume space, introducing the concentrate or ore into a denitrating vessel along with solution from the leach solution, reacting essentially all of the oxidized nitrogen species in the leach solution in the denitrating vessel with concentrate or ore to produce in the denitrating vessel nitric oxide, which is released into an oxygen free gas phase and is transported to the gas phase of the common volume space, subjecting the liquid and solid products of the denitrating vessel top a solid-liquid separation, transporting the solids from the separation to the common volume space where the solids are treated with oxygen and with nitric oxide from said denitrating vessel, and bleeding the remaining liquid which is free of oxidized nitrogen species from the process.

2. A hydrometallurgical process for the recovery of precious metal from an ore or concentrate containing arsenopyrite or pyrite wherein precious metal is occluded in arsenopyrite or pyrite, which process comprises:

(a) introducing into a denitrating vessel, a liquid slurry made up of pyrite or arsenopyrite concentrates ore and a recycled liquid obtained from step (d) below, where the concentrate or ore is subjected to an oxygen-reduction reaction with a recycled solution which is derived from the precious after precious metal has been precipitated as defined in step (m) below;

(b) continuously removing from the denitrating vessel nitric oxide gas which is generated in an oxygen free gas phase in the denitrating vessel;

(c) continuously withdrawing the treated concentrate or ore from the denitrating vessel and subjecting it to a solid-liquid separation;

(d) recycling a sufficient quantity of the liquid from the solid-liquid separation which liquid is free of oxidized nitrogen species to the pyrite or arsenopyrite concentrate or ore of step (a) to generate a liquid slurry, and discarding the remaining liquid from the process;

(e) transporting the solids from the solid-liquid separation to a common volume space;

(f) forming in the common volume space a gas phase which gas phase comprises nitric oxide gas from step (b) above and added oxygen, and a liquid slurry, which slurry comprises the solids from step (d) as the solid phase, and acid and added water as the liquid phase;

(g) effecting in the liquid slurry between the arsenopyrite or pyrite and an oxidized nitrogen species in which the nitrogen has a valence of at least plus 3 an oxidation-reduction reaction having a standard potential between 0.90 and about 1.20 volts on the hydrogen scale, thereby solubilizing in the liquid phase the arsenic, iron and sulphur in the arsenopyrite, or the iron and sulphur in the pyrite, all as the oxidation products, and producing in the liquid phase nitric oxide in which the nitrogen has a valence of plus 2, as the reduction products;

(h) releasing at least part of the nitric oxide generated in the liquid phase into the gas phase in the common volume space;

(i) oxidizing the nitric oxide in the gas phase in the common volume space in which an oxygen partial pressure is maintained by continuous addition of an oxygen containing gas, to form an oxidized nitrogen species in which the nitrogen has a valence of at least plus 3, the total amount of oxygen added being at least in an amount stoichiometrically required for solubilization in the liquid phase of the arsenic, iron and sulphur in the arsenopyrite or the iron and sulphur in the pyrite;

(j) absorbing the oxidized nitrogen species into the liquid slurry of the common volume space wherein the oxidized nitrogen species become available for the oxidation-reduction reaction of step (g) whereby the nitrogen, in its oxide forms, functions as a catalyst for the transport of oxygen from the gas phase to the oxidation-reduction reactions in the liquid slurry, thereby permitting the total of the oxidized nitrogen species and nitric oxide in the system to be less than a stoichiometric balance required for the oxidation of the arsenic, iron and sulphur;

(k) subjecting the liquid slurry to a solid-liquid separation to produce solid residue and a liquid fraction;

(l) recovering precious metal from the solid residue; and (m) recycling the liquid fraction of step (k) to step (a) of the process.

3. A process as defined in claim 2 wherein the oxidation-reduction reaction has a standard potential of at least 0.94 and less than about 1.0 volts on the hydrogen scale.

4. A process as defined in claim 3 wherein the nitrogen in the oxidized nitrogen species has a valence of +3 or +4.

5. A process as defined in claim 4 wherein the liquid fraction from the solid-liquid separation is treated for gold and silver recovery before the liquid fraction is recycled to step (a) of the process.

6. A process as defined in claim 4 wherein the solubilized iron, arsenic and sulphur are precipitated from the liquid fraction of step (k) and the precipitated iron, arsenic and sulphur are removed from the process before the liquid fraction is recycled to step (a) of the process.

7. A process as defined in claim 4 wherein the oxidation-reduction reaction in the common volume space and the denitrating vessel is conducted at a temperature of about 60° C. to about 180° C.

8. A process as defined in claim 4 wherein the oxidation-reduction reaction in the common volume space and the denitrating vessel is conducted at a pH of less than about 3.

9. A process as defined in claim 4 wherein the oxidation-reduction reaction in the common volume space and the denitrating vessel is conducted at a pH of less than or equal to about 1.

10. A process as defined in claim 4 wherein the oxidized nitrogen species concentration in the common volume space is between about 0.25 M and about 4.0 M.

11. A process as defined in claim 4 wherein the oxidized nitrogen species concentration in the common volume space is between about 0.5 M and about 3.0 M.

12. A process as defined in claim 4 wherein the oxygen partial pressure in the common volume space is at least about 50 psig.

13. A process as defined in claim 4 wherein the partial pressure of the nitric oxide in the denitrating vessel is greater than the pressure in the common volume space.

14. A process as defined in claim 2 wherein solubilized iron, arsenic or sulfur withdrawn in the liquid from solid-liquid separation step (c) is precipitated as jarosite and ferric arsenate from the liquid fraction by raising the temperature of the liquid fraction to a temperature of about 100° C. and removing precipitated solids from the liquid fraction.

15. A process as defined in claim 2 wherein solubilized iron, arsenic or sulfur withdrawn in the liquid from solid-liquid separation step (c) is precipitated as jarosite, ferric arsenate, and anhydrite from the liquid fraction by neutralizing surplus acid generated during sulphide leaching, and removing precipitated solids from the liquid fraction.

16. A process as defined in claim 15 wherein a calcium bearing substance is used to remove solubilized sulphur from the liquid fraction, ferric arsenate is added as a nucleating agent, and the liquid fraction is heated to precipitate ferric arsenate.

17. A process as defined in claim 2 wherein the common volume space is a tubular reactor.

18. A process as defined in claim 2 wherein the denitrating step is carried out in a tubular reactor.

* * * * *